US012800206B2

(12) United States Patent
Jacubasch et al.

(10) Patent No.: US 12,800,206 B2
(45) Date of Patent: Nov. 17, 2026

(54) COLD EXCHANGE SYSTEM

(71) Applicant: Siemens Schweiz AG, Zürich (CH)

(72) Inventors: Andreas Jacubasch, St. Leon-Rot (DE); Kamil Podjuk, Ostrzeszów (PL); Thomas Walch, Remchingen (DE); Siyuan Wang, Rastatt (DE)

(73) Assignee: SIEMENS SCHWEIZ AG, Zurich (CH)

( * ) Notice: Subject to any disclaimer, the term of this patent is extended or adjusted under 35 U.S.C. 154(b) by 24 days.

(21) Appl. No.: 18/887,416

(22) Filed: Sep. 17, 2024

(65) Prior Publication Data

US 2025/0093083 A1 Mar. 20, 2025

(30) Foreign Application Priority Data

Sep. 18, 2023 (EP) ..... 23197996

(51) Int. Cl.
*F25B 49/02* (2006.01)
*F25B 41/345* (2021.01)

(52) U.S. Cl.
CPC ..... *F25B 49/02* (2013.01); *F25B 41/347* (2021.01); *F25B 2600/2513* (2013.01); *F25B 2700/06* (2013.01); *F25B 2700/2103* (2013.01)

(58) Field of Classification Search
CPC ..... F16K 37/0041; F25B 49/02; F25B 41/34; F25B 41/347; F25B 2700/21172; F25B 2700/21173; F24F 11/83
See application file for complete search history.

(56) References Cited

U.S. PATENT DOCUMENTS 5,927,400 A 7/1999 Bononi
6,435,207 B1 8/2002 Mewes
(Continued)

FOREIGN PATENT DOCUMENTS

DE 102015213230 B4 1/2022
EP 3839308 A1 6/2021
(Continued)

OTHER PUBLICATIONS

Japanese Decision of Rejection, Application No. 2024-142360, 13 pages, May 12, 2026.
(Continued)

*Primary Examiner* — Frantz F Jules
*Assistant Examiner* — Martha Tadesse
(74) *Attorney, Agent, or Firm* — Slayden Grubert Beard PLLC

(57) ABSTRACT

Various embodiments of the teachings herein include a cold exchange system. An example includes: thermal energy exchangers connected to a refrigerant pipe system; and a control system comprising: an orifice adjusting system including a valve and an actuator, the valve comprising a flow chamber with an adjustable orifice in the pipe; a position sensor to sense a position of the adjustable orifice and/or the actuator and generate a signal indicative of the sensed position; and a controller. The orifice adjusting system adjusts the adjustable orifice in response to a control signal. The control system uses a software-wise change of a characteristic curve of the orifice adjusting system. The position sensor operates using a static measurement principle. The controller compares the signal to a set position of the adjustable orifice and generates the control signal based on the comparison.

14 Claims, 3 Drawing Sheets

(56) References Cited

U.S. PATENT DOCUMENTS

| | | | | |
|---|---|---|---|---|
| 7,693,606 | B2 | 4/2010 | Ahmad et al. | 700/282 |
| 7,769,493 | B2 * | 8/2010 | Elshafei | G05D 7/0635 700/282 |
| 9,329,066 | B2 | 5/2016 | Skarping et al. | |
| 10,724,509 | B2 | 7/2020 | Domke | |
| 2003/0001346 | A1 | 1/2003 | Hamilton et al. | 280/5.515 |
| 2005/0189017 | A1 | 9/2005 | Eryurek | 137/487.5 |
| 2020/0284361 | A1 | 9/2020 | Beck | |
| 2022/0003335 | A1 | 1/2022 | Huwiler et al. | |
| 2022/0107033 | A1 * | 4/2022 | Schneider | F25B 49/02 |
| 2022/0128278 | A1 * | 4/2022 | Parker | F25B 49/005 |

FOREIGN PATENT DOCUMENTS

| | | | | |
|---|---|---|---|---|
| EP | 3869292 | A1 * | 8/2021 | G05D 7/06 |
| JP | 2007522563 | A | 8/2007 | F16K 31/12 |
| JP | 2011508919 | A | 3/2011 | G01F 1/00 |
| JP | 2013521495 | A | 6/2013 | G01F 1/68 |
| JP | 2017141998 | A | 8/2017 | F24F 11/02 |
| JP | 2019007563 | A | 1/2019 | B66F 9/20 |
| JP | 2022168396 | A | 11/2022 | F16K 37/00 |
| WO | 9206422 | A1 | 4/1992 | |
| WO | 9825086 | A1 | 6/1998 | |
| WO | 00/27658 | A1 | 5/2000 | B60G 17/015 |
| WO | 2008039065 | A1 | 4/2008 | |

OTHER PUBLICATIONS

Bradley, D.A., et al., "Mechantronics—Electronics in Products and Processes," In: Mechantronics—Electronics in products and processes, Chapman & Hall, London, XP093410274, pp. 40-42.
Liptak, Bela G., "Instrument Engineers' Handbook " In: Instrument Engineers' Handbook, XP093410258, pp. 945-950.
European Office Action, Application No. 23197996.4, 10 pages.

* cited by examiner

COLD EXCHANGE SYSTEM

CROSS-REFERENCE TO RELATED APPLICATIONS

This application claims priority to EP Application Serial No. 23197996.4 filed Sep. 18, 2023, the contents of which are hereby incorporated by reference in their entirety.

TECHNICAL FIELD

The present disclosure relates to cooling systems. Various embodiments of the teachings herein include systems and/or methods for use in cooling applications.

BACKGROUND

An example cooling system comprises a valve for controlling a flow of a medium passing through a pipe part of a pipe system. The medium is distributed via the pipe system to a plurality of consumer devices and/or thermal energy exchangers. The cooling system can comprise a common source and the pipe system can connect to the common source. In commercial and/or industrial and/or residential buildings, several applications are known which make use of a pipe system. The pipe system distributes a medium to various consumer devices spread over the building. The medium typically originates from a common source.

A pipe system may be or comprise a closed circuit. The closed circuit comprises one or more supply pipes connecting the common source with each of the consumer devices. The closed circuit also comprises one or more return pipes connecting each of the consumer devices back to the common source. The consumer devices may comprise thermal energy exchangers. The consumer devices may be thermal energy exchangers. More specifically, the consumer devices can comprise cold exchange systems.

The pipe system may also be or comprise an open circuit. The open circuit comprises one or more supply pipes connecting the common source with each of the consumer devices. In contrast to closed circuits, there is no return pipe that connects each and every consumer device back to the common source. A pipe system can still be a combination of a closed circuit and an open circuit.

These systems can include valves such as control valves having an adjustable orifice system for controlling the flow of a medium to the respective consumer device. A position of an adjustable orifice of the adjustable orifice system determines the amount of medium passing through the consumer device per time unit. In cold exchange applications, this means that the position of the orifice determines an amount of cooling delivered from the thermal energy exchanger to an adjacent space. The adjacent space may be an adjacent room of a building.

The flow rate of a medium passing through the consumer device is not only determined by the position of the adjustable orifice. That flow rate is also influenced by the pressure at which the medium passes through the consumer device. In addition to pressure and the position of the orifice, other factors can influence flow rates. This pressure depends, by way of non-limiting example, on the distance between the common source and the consumer device. This frequently applies to commercial and/or industrial buildings. The pipe system and the consumer devices can spread over a plurality of different floors of such buildings. Commercial and/or industrial buildings can, by way of example, be office buildings.

The pressure at a specific consumer device may even vary over time. The pressure can, by way of non-limiting example, vary after closing or opening a valve in a pipe connected to one or more other consumer devices. In cold exchange applications, the closing of such a valve can lead to an increase of the pressure of the medium.

The increase in pressure can then impact on other thermal energy exchangers in the same circuit. In consequence of the increase in pressure, flow rates toward those other thermal energy exchangers increase. Any amounts of thermal energy delivered by the thermal energy exchangers to adjacent spaces can then also increase. This is not desired.

Several systems were already developed in an attempt to provide control of the medium flow through a pipe system.

International patent application WO92/06422A1 deals with automatic regulation of a flow rate in a fluid distribution network as a function of pressure variations. WO92/06422A1 relates to a system for automatically adjusting medium flow to set medium flow. The adjustment is independent of pressure variations between the supply end and the return end of the thermal energy exchanger. To this end, the control system comprises a first medium flow control unit. The first medium flow control unit is set to a predetermined value. The control system also comprises a second medium flow control unit that affords a variable pressure loss. The system further comprises an actuator for automatically compensating detected variations of pressure loss between the supply end and the return end of the thermal energy exchanger. In so doing, the second flow medium control unit closes to a certain extent. The pressure difference between the supply end and the return and, and thus the set medium flow, is only set once.

U.S. Pat. No. 6,435,207B1 describes a flow regulation control valve for setting and measuring volume flow in pipes. The flow regulation control valve comprises a shut-off member arranged in a flow chamber, for setting a desired flow state. A sensor is arranged in or adjacent the flow chamber, for sensing a value representative of a flow through the flow chamber. The flow regulation control valve further comprises an evaluation unit. The evaluation unit determines the flow from the signal recorded by the sensor and from the characteristic values of the control valve. Those characteristic values are stored in an electronic data store at the sensor and are valve specific. A flow rate through a section of the pipe system is manually adjusted using the shut-off member of the flow regulation control valve. The flow rate is adjusted until the desired flow is displayed by the evaluation unit.

U.S. Pat. No. 5,927,400A deals with adjustments of the flow rate of a liquid with closed-loop control. U.S. Pat. No. 5,927,400A discloses a flow control system for controlling flow to a thermal energy exchanger. The system comprises a turbine type flow sensor in which a turbine is driven by a flowing medium. The number of revolutions per time unit of the turbine is counted to estimate the flow rate of the medium at the turbine. The sensor outputs a pulse signal created by magnets of the turbine, so the number of pulses per time unit is a measure for the flow rate. A set flow rate is derived from a temperature setting. An evaluation unit uses preset characteristics depending on the flow range and compares the measured flow rate to the set flow rate. A valve is operated accordingly.

Patent application WO2008/039065A1 deals with a device, with a system and with a method for controlling a heating system. WO2008/039065A1 discloses a device for controlling a system for thermal energy exchange within one or more rooms in a building. The control device comprises a meter of the invoicing type. The meter is connectable to the supply conduit and/or return conduit and determines an amount of thermal power delivered by a medium flowing through a conduit. The meter produces an indication of the thermal energy supplied over a determined period. A control unit can connect to an adjusting unit. That unit controls an amount of thermal power delivered by the medium flowing through the adjusting unit. More specifically, the unit controls an amount of thermal power delivered by the medium in response to signals obtained from the meter.

Patent application WO98/25086A1 discloses a modulating fluid control device for a fluid-based heating and cooling system for a measured environment. The control device comprises a body, a supply port and a return port and a valve located between these ports. The valve connects to an actuator. The actuator and the valve are responsive to input from a sensor and from a controller. A flow of a medium through the valve is thereby restricted, the restriction depending on conditions in the measured environment. The control device is provided with a valve controller and an actuator to position the valve and thereby regulate flow through that valve.

A flow sensor is associated with the valve and records the flow of the medium at a location in the system. The flow sensor provides a signal indicative of that flow rate to the valve controller. The flow sensor and the valve controller maintain a required flow rate through the system as recorded by the sensor. The system thereby promotes desired environmental conditions in a space.

European patent application EP3839308A1 deals with an expansion valve. The valve comprises an inlet port, an outlet port, and an adjustable orifice situated in a fluid path between the inlet port and the outlet port. The adjustable orifice system comprises the adjustable orifice and an armature. An electric current through a solenoid causes movement of the armature and of the adjustable orifice. The solenoid is directly immersed in a refrigerant.

SUMMARY

Teachings of the present disclosure describe widely applicable control systems with accurate control over the entire applicability range. They may be used in systems wherein no flow measurements are available. It may then be necessary to control flow and to control a valve based on a signal from a position sensor. For example, some embodiments of the teachings herein include a cold exchange system (1) comprising: a control system and one or more thermal energy exchangers (3) connected to a pipe system via which a refrigerant is distributed, the control system being associated with at least one of the one or more thermal energy exchangers (3), the control system comprising: an orifice adjusting system (5, 6) being formed by a two-way or three-way valve (5) and by an actuator (6), the valve (5) comprising a flow chamber with an adjustable orifice (11, 12) in the pipe part; the control system comprising a position sensor (7) configured to sense a position of the adjustable orifice (11, 12) and/or of the actuator (6) and to output a signal indicative of the sensed position; the control system comprising a controller (8) in communicative connection with the orifice adjusting system (5, 6) and with the position sensor (7); the orifice adjusting system (5, 6) being configured to adjust the adjustable orifice (11, 12) in response to a control signal; wherein a software-wise change of a characteristic curve of the orifice adjusting system (5,6) is implemented in the control system; characterised in that the position sensor has a static measurement principle and in that the controller (8) is configured to compare the signal indicative of the sensed position with a set position of the adjustable orifice (11, 12) and to output the control signal based on the comparison.

In some embodiments, the position sensor (7) comprises at least one inductor.

In some embodiments, the at least one inductor of the position sensor (7) envelopes a moveable portion of at least one of the adjustable orifice (11, 12), and the actuator (6).

In some embodiments, the position sensor (7) comprises an amplifier electrically connected to the at least one inductor, the amplifier being configured to amplify a current signal received from the at least one inductor and to output the signal indicative of the sensed position in analog form.

In some embodiments, the position sensor (7) comprises an amplifier electrically connected to the at least one inductor and an analog-to-digital converter electrically connected to the amplifier, the amplifier being configured to amplify a current signal received from the at least one inductor and to output the amplified signal to the analog-to-digital converter; and the analog-to-digital converter being configured to output the signal indicative of the sensed position in digital form in response to receiving the amplified signal.

In some embodiments, the position sensor (7) comprises an amplifier electrically connected to the at least one inductor and a sigma-delta converter electrically connected to the amplifier, the amplifier being configured to amplify a current signal received from the at least one inductor and to output the amplified signal to the sigma-delta converter; and the sigma-delta converter being configured to output the signal indicative of the sensed position in digital form in response to receiving the amplified signal.

In some embodiments, the characteristic curve is changed from a linear characteristic curve (16) to a characteristic curve different from the linear characteristic curve (16), or vice versa; wherein the controller (8) comprises a non-volatile memory storing a firmware; and wherein the software-wise change of the characteristic curve of the orifice adjusting system (5, 6) is implemented using the firmware of the controller (8).

In some embodiments, the characteristic curve is changed from an equal-percentage characteristic curve (19) to a characteristic curve different from the equal-percentage characteristic curve (16), or vice versa; wherein the controller (8) comprises a non-volatile memory storing a firmware; and wherein the software-wise change of the characteristic curve of the orifice adjusting system (5, 6) is implemented using the firmware of the controller (8).

In some embodiments, the control system comprises a first temperature sensor provided along the pipe system in a position in front of the at least one thermal energy exchanger (3); and the first temperature sensor is configured to sense a supply temperature of the refrigerant entering the at least one thermal energy exchanger (3).

In some embodiments, the control system comprises a second temperature sensor provided along the pipe system in a position behind the at least one thermal energy exchanger (3); and the second temperature sensor is configured to sense a return temperature of the refrigerant leaving the at least one thermal energy exchanger (3).

In some embodiments, the control system comprises a communication link toward a central controller.

In some embodiments, the controller (8) of the control system is configured to communicate at least one of the signal indicative of the sensed position, a value derived from the signal indicative of the sensed position and to the central controller via the communication link.

In some embodiments, the controller (8) is in communicative connection with the first and second temperature sensors; the first and second temperature sensors are configured to output temperature signals and to send them to the controller (8); the controller (8) is configured to receive the temperature signals from the temperature sensors and to determine a differential temperature as a function of the temperature signals; and the controller (8) is configured to communicate the differential temperature to the central controller via the communication link.

In some embodiments, the refrigerant is chosen from at least one of a R-401A refrigerant, a R-404A refrigerant, a R-406A refrigerant, a R-407A refrigerant, a R-407C refrigerant, a R-408A refrigerant, a R-409A refrigerant, a R-410A refrigerant, a R-438A refrigerant, a R-500 refrigerant, a R-502 refrigerant, ammonia, and a mixture thereof.

BRIEF DESCRIPTION OF THE DRAWINGS

Various features are apparent to those skilled in the art from the following detailed description of the disclosed non-limiting embodiments. The drawings that accompany the detailed description can be briefly described as follows.

DETAILED DESCRIPTION

Figure 1:
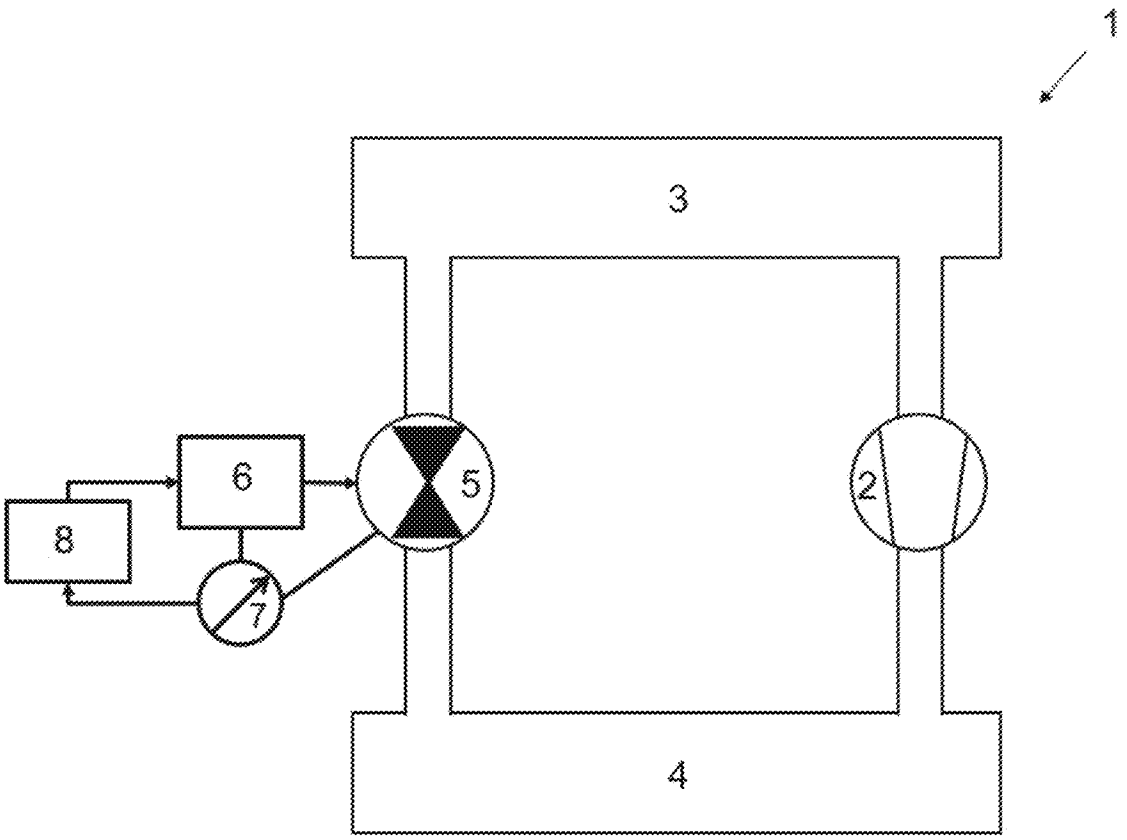
FIG. 1 shows a valve for a cooling circuit incorporating teachings of the present disclosure.

As used herein, the term medium means any liquid, gas, smoke, aerosol, flowing solid or any mixture thereof. The term medium can also refer to any other flowing medium known to the person skilled in the art. More specifically, the term medium can refer to a refrigerant. Some example refrigerants may include:

a R-401A refrigerant,
a R-404A refrigerant,
a R-406A refrigerant,
a R-407A refrigerant,
a R-407C refrigerant,
a R-408A refrigerant,
a R-409A refrigerant,
a R-410A refrigerant,
a R-438A refrigerant,
a R-500 refrigerant,
a R-502 refrigerant, and/or
ammonia.

As used herein, "in front of device A" means "in front of device A, taken in flow direction of the medium". Likewise, "behind device A" means "behind device A, taken in flow direction of the medium".

As used herein, the term "thermal energy exchange" preferably refers to cooling operations. The term "thermal energy exchange" can also refer to heating operations.

As used herein, the term "consumer device" refers to any device which delivers thermal energy supplied via the medium. More specifically, the "consumer device" can provide cooling and the cooling is supplied via the medium. Still more specifically the "consumer device" can provide cooling and the cooling is supplied via a refrigerant.

In some embodiments, a control valve for a cold exchange system of the present disclosure comprises: a sensor for recording a position of an adjustable orifice of the valve; a controller in communicative connection with the sensor, the controller being configured to evaluate the recorded position; the controller being configured to produce a control signal based on the evaluation and to output the control signal; the valve comprising an orifice adjusting system in communicative connection with the controller, the orifice adjusting system comprising a flow chamber and the adjustable orifice arranged in the flow chamber; and the orifice adjusting system being provided for adjusting the adjustable orifice in response to the control signal of the controller.

The sensor produces an electric signal indicative of the sensed actual position of the adjustable orifice. A value representing a set position of the adjustable orifice can be a desired position of the adjustable orifice. A value representing a set position of the adjustable orifice can still be a setting from which a desired position of the adjustable orifice is derived. The set position of the adjustable orifice can, by way of non-limiting examples, be derived from a temperature set point of a room or of a space. A value representing the set medium flow can be a desired flow value or a setting from which a desired flow value is derived. The set medium flow can, by way of non-limiting example, be derived from a temperature set point of a room or of a space.

In some embodiments, the sensor is arranged at or near the orifice adjusting system. The orifice adjusting system may comprise an actuator and/or an adjustable orifice. The sensor is arranged at or near the actuator and/or the adjustable orifice such that the sensor can record the actual position of the adjustable orifice. In some embodiments, the adjustable orifice comprises a valve member. The sensor is arranged at or near the valve member such that the sensor can record the actual position of the valve member.

Valves are frequently controlled via flow sensors. Yet, flow sensors are not always available. As regards position sensors, these sensors often comprise potentiometers. Potentiometers are, however, prone to mechanical wear. Operation of a valve such as a control valve involves valve cycles and those cycles cause degradation of the position sensor. That is, the valve can eventually fail due to a defective position sensor.

In some embodiments, a sensor operates on a static measurement principle. Sensors having a static measurement principle dispense with moving parts. The same may be advantageous in view of mechanical wear. The sensor may be chosen such that its accuracy is not limited by a mechanical position of a wiper along a resistance element. The sensor is not then prone to degradations caused by moisture and dust on the surface of a wiper or of a resistance element. The sensor should also not be prone to malfunctions caused by particles obstructing an optical path.

In some embodiments, the sensor comprises an inductive sensor. The inductive sensor comprises an inductor. An electric current through the inductor will change when a magnetic field such as a magnetic flux through the inductor changes. More specifically, an electric current through the inductor will change when a movement of the adjustable orifice causes a decrease or an increase in magnetic flux. This requires that the adjustable orifice system or parts of the adjustable orifice system are permanently or temporarily magnetic. The adjustable orifice system or parts of the adjustable orifice system can, by way of non-limiting example, be ferromagnetic. In some embodiments, the adjustable orifice system comprises a ferromagnet selected from at least one of:

a neodymium magnet such as a NdFeB magnet,
a sintered $Nd_2Fe_{14}B$ magnet,
a bonded $Nd_2Fe_{14}B$ magnet,
a samarium-cobalt SmCo magnet,
a sintered $SmCo_5$ magnet, a sintered Sm(Co, Fe, Cu, Zr)$_7$ magnet, ferrite steel, and DIN/EN 1.0715 steel in accordance with the standard EN 10277:2018.

In some embodiments, an electric current through the inductor will change when a movement of the valve member causes a decrease or an increase in magnetic flux. This requires that the valve member or parts of the valve member are permanently or temporarily magnetic. The valve member of parts of the valve member can, by way of non-limiting example, be ferromagnetic. In some embodiments, the valve member comprises a ferromagnet selected from at least one of:

a neodymium magnet such as a NdFeB magnet, a sintered $Nd_2Fe_{14}B$ magnet, a bonded $Nd_2Fe_{14}B$ magnet, a samarium-cobalt SmCo magnet, a sintered $SmCo_5$ magnet, a sintered Sm(Co, Fe, Cu, Zr)$_7$ magnet, ferrite steel, and DIN/EN 1.0715 steel in accordance with the standard EN 10277:2018.

Armatures comprising ferrite steel need not be ferromagnetic.

In some embodiments, the inductive sensor comprises a linear variable inductive transducer (LVIT). The inductive sensor ideally is a linear variable inductive transducer (LVIT). A LVIT relies on a flux difference between two coils. The LVIT is robust against changes in temperature since both coils have the same physical properties. The flux difference is thus an exclusive function of a target such as an armature.

A sensor comprising a LVIT can be used in conjunction with armatures comprising ferrite steel and/or DIN/EN 1.0715 steel. The LVIT then effectively measures a change in inductance. That change in inductance is caused by an armature comprising ferrite steel and/or DIN/EN 1.0715 steel moving relative to the coils of the LVIT.

The inductive sensor may also comprise a current sensing member. The current sensing member senses an electric current through the inductor. In some embodiments, the current sensing member senses an electric current through the winding of the inductor. The current sensing member can be electrically connected in series with the inductor and/or with the winding of the inductor.

In some embodiments, the inductive sensor comprises a current gain member such as an amplifier. The current gain member amplifies the electric current through the inductor and/or through the winding of the inductor. The amplified electric current can then be processed by a signal processing circuit and/or by a microcontroller and/or by a microprocessor.

In some embodiments, the inductive sensor is or comprises a LVIT. In operation, a voltage difference is observed for each of the two coils of the LVIT. The voltage difference is then evaluated to determine and/or to estimate a position of a target. More specifically, the voltage difference is evaluated to determine and/or to estimate a position of an armature.

In some embodiments, the sensor output is an electric signal. The output signal of the sensor can be an analog signal or a digital electric signal. The controller may directly process the output signal originating from the sensor. In so doing, the control valve provides a fast response to movements of adjustable orifice and/or of the valve member. A fast response of the valve implies, by way of non-limiting example, that the valve can quickly respond to flash gas in a refrigerant circuit. A fast response of the valve also implies, by way of non-limiting example, that the valve can quickly close in the event of abnormal operation.

In some embodiments, the controller makes an evaluation on the position signal. That is, the controller directly compares the sensed position of the adjustable orifice and/or of the valve member with a set position of the adjustable orifice. More specifically, the controller directly compares the signal originating from the inductive position sensor to the set position of the adjustable orifice. This can contribute to faster response times with respect to prior art systems. For example, systems in which power intake is evaluated tend to be slower than the system of the instant disclosure.

In some embodiments, the sensor is arranged close to the adjustable orifice and/or close to an actuator of the adjustable orifice system. That way, inaccuracies caused by stray magnetic fields can be avoided. In some embodiments, the closest distance between the inductive sensor and the actuator and/or the adjustable orifice is less than twenty millimeters. The closest distance between the inductive sensor and the actuator and/or the adjustable orifice can even be less than ten millimeters. In some embodiments, the closest distance between the inductive sensor and the actuator and/or the adjustable orifice can be less than five millimeters.

Where the inductive sensor is or comprises a LVIT, inaccuracies caused by stray magnetic fields are largely avoided.

In some embodiments, the orifice adjusting system is constructed such that it has an equal-percentage characteristic curve. The adjustable orifice consequently is less sensitive at lower flow rates than at higher flow rates. This equal-percentage characteristic curve can be achieved by shaping the parts forming the adjustable orifice. For example, ball valves and butterfly valves tend to have equal-percentage valve curves.

An actuator of the adjustable orifice system actuates one or more parts of the adjustable orifice system thereby adjusting the adjustable orifice and/or the valve member. More specifically, the actuator adjusts the position of the adjustable orifice and/or the position of the valve member. The equal-percentage characteristic curve can also be achieved or be changed by processing a control signal sent to the actuator of the adjustable orifice system.

For example, the control signal can be processed to impart a smaller relative movement in a first range starting at zero percent opening of the adjustable orifice. The control signal can also be processed to impart a larger relative movement in a second range above a given opening of the adjustable orifice. The control signal can still be processed to impart a smaller relative movement in a first range starting at zero percent opening of the valve member. The control signal can also be processed to impart a larger relative movement in a second range above a given opening of the valve member. The combination of a sensor of the type described above can lead to a highly accurate and widely applicable control valve.

In some embodiments, the sensor can be positioned in front of at least one consumer device. More specifically, the sensor can be positioned in front of at least one thermal energy exchanger. In closed systems, the sensor can be positioned behind at least one consumer device. More specifically, the sensor can be positioned behind at least one thermal energy exchanger. A position in front of the at least one consumer device can improve on longer-term performance because the sensor operates at a lower temperature. Likewise, a position in front of the at least one thermal energy exchanger can improve on longer-term performance because the sensor operates at a lower temperature.

A position of the sensor in the supply pipe of a consumer device may have the advantage of avoiding adverse effects of turbulences caused by the consumer device. Likewise, a position in the supply pipe of a thermal energy exchanger has the advantage of avoiding adverse effects of turbulences caused by the thermal energy exchanger.

In some embodiments, the control valve comprises a communication link towards a central unit. The communication link affords communication of certain measured or derived values, such as position signals or error signals, to the central unit. The central unit can then monitor such signals. The communication link can be wireless or hard-wired. The communication link can, for instance, rely on wireless solutions such as EnOcean® and/or KNX® RF and/or Thread and/or WLAN and/or Zigbee. In some embodiments, hard-wired connections such as Ethernet® cables or on KNX® cables are used. In some embodiments, communication involves a digital communication bus and/or a digital communication protocol.

In some embodiments, the controller provides a communication link towards a central unit. The communication link affords communication of certain measured or derived values, such as position signals or error signals, to the central unit. The central unit can then monitor such signals. The communication link can be wireless or hard-wired. The communication link can, for instance, rely on wireless solutions such as EnOcean® and/or KNX® RF and/or Thread and/or WLAN and/or Zigbee. In some embodiments, there are hard-wired connections such as Ethernet® cables or on KNX® cables. In some embodiments, communication involves a digital communication bus and/or a digital communication protocol.

In some embodiments, a decentralised reading unit associated with each consumer device can be used for monitoring purposes. More specifically, a decentralised reading unit associated with each of thermal energy exchanger can be used for monitoring purposes.

A value representing the set position of the adjustable orifice can be input into the controller by any means considered suitable by the skilled practitioner. Suitable input means include, but are not limited to, an external analogue signal and an external digital signal. The position of the adjustable orifice can also be set by a wireless signal such as a digital wireless signal. The set position of the adjustable orifice can still be a factory preset. Factory presets also include, but are not limited to, end positions of the adjustable orifice and/or of the valve member.

In some embodiments, the set position of the adjustable orifice can be directly entered into the controller or communicated by a user. The set position of the adjustable orifice can also be directly entered into the controller or communicated by an operator. In some embodiments, a user enters or communicates a desired temperature such as a desired room temperature. In some embodiments, an operator enters or communicates a desired temperature such as a desired room temperature. The controller then derives a set position of the adjustable orifice from this temperature. The set position of the adjustable orifice in cooling applications will often be linked to a desired position needed to obtain a certain temperature in a space.

In some embodiments, the set position of the adjustable orifice is communicated to each valve controller of a plurality of valve controllers via a system controller. To that end, the set position of the adjustable orifice or a temperature linked to the set position of the adjustable orifice is entered into the system controller. The set position of the adjustable orifice or a temperature linked to the set position of the adjustable orifice can also be communicated to the system controller. The system controller sends such set positions of the adjustable orifice to the valve controllers via a communication bus such as a digital communication bus. The decentralised solution alleviates efforts during commissioning and/or installation.

In some embodiments, the set position of the adjustable orifice is communicated to each cluster of valve controllers of a plurality of such clusters. The set position may be communicated via a system controller. To that end, the set positions of the adjustable orifices of one or more clusters is entered into the system controller. A temperature linked to the position of the adjustable orifice of one or more clusters can also be entered into the system controller. These set positions of the adjustable orifice or temperatures can even be communicated to the system controller. In some embodiments, the system controller sends such set positions of the adjustable orifices to the clustered valve controllers via a communication bus such as a digital communication bus. The clustered solution alleviates efforts during commissioning and/or installation.

In some embodiments, the set position of the adjustable orifice is individually communicated to each valve controller of a plurality of valve controllers. To that end, the set position of the adjustable orifice or a temperature linked to the set position of the adjustable orifice is entered into each valve controller. The set position of the adjustable orifice or a temperature linked to that position of the adjustable orifice can also be individually communicated to each valve controller.

The set position of the adjustable orifice corresponds to the desired position of the adjustable orifice. It can vary between a fully closed valve and a fully open valve. It can also vary between a partially closed valve and a fully open valve. A set position of the adjustable orifice not allowing a fully closed valve can be advantageous in installations where a valve must not fully close. For example, it can be advantageous to not close valves in systems with flow control. It is also envisaged to limit the range of possible positions of the adjustable orifice between $d_{min}$ and $d_{max}$. $d_{min}$ can correspond to a fully closed or to a partially closed valve. $d_{max}$ can correspond to a degree of opening which is less than fully open.

The actuator can be any type of actuator known to the person skilled in the art such as a motor. In some embodiments, the actuator comprises a stepper motor.

The controller will compare the actual position of the adjustable orifice received from the sensor with the set position of the adjustable orifice. The controller will then produce a control signal based on that comparison. This control signal is communicated to the actuator. The actuator then adjusts the adjustable orifice until the actual position of the adjustable orifice equals the set position of the adjustable orifice. It seems worth stressing that the control loop needs not terminate when the actual position of the adjustable orifice equals the set position of the adjustable orifice.

In some embodiments, the control valve for the cooling system incorporating teachings of the present disclosure affords control of a medium flow. The valve can additionally be used to determine and/or control other variables. As an example, but not being limited thereto, the valve can be used to control the velocity of the medium flowing through the pipe part. The velocity of the medium can be controlled such that it does not exceed a given threshold value.

That control mode mitigates noise. An amount of cooling delivered by a thermal energy exchanger can, by way of another example be controlled. The amount of cooling can be specified as an amount of energy and/or as an amount of power. It can be visualised clustered, centralised or decentralised.

The different components of the valve for the cooling system may form one single system or two or more separate systems.

FIG. 1 shows an example cold exchange system 1 incorporating teachings of the present disclosure. The cold exchange system comprises a pipe system forming a cooling circuit. A compressor 2, an evaporator 3, and a condenser 4 are arranged in the pipe parts of the cooling circuit. A valve 5 such as a control valve is also arranged in a pipe part of the cooling circuit.

An actuator 6 mechanically connects to the control valve 5. The control valve 5 comprises an inlet port, an outlet port and a fluid path extending between the inlet port and the outlet port. The control valve 5 also comprises an adjustable orifice system having an adjustable orifice acting on the fluid path. The actuator 6 is configured to move the adjustable orifice between a closed position and an open position. In the closed position, the adjustable orifice obturates the fluid path. There will consequently be no flow through the valve 5. In the open position, the adjustable orifice opens the fluid path thereby enabling flow of a medium such as a refrigerant through the fluid path.

In some embodiments, the actuator 6 causes stepwise movements of the adjustable orifice. In other words, an actual position of the adjustable orifice can be adjusted in steps. The actuator 6 can comprise a motor such as a stepper motor. The stepper motor typically provides one hundred or two hundred steps to adjust the position of the adjustable orifice.

In some embodiments, the actuator 6 causes continuous movements of the adjustable orifice. In other words, an actual position of the adjustable orifice can continuously be adjusted. The actuator 6 can, by way of non-limiting example, comprise a linear actuator.

The actuator 6 can be an item that is separate from the control valve 5. In some embodiments, the control valve 5 comprises the actuator 6. The control valve 5 and the actuator 6 can even be arranged inside the same housing. In some embodiments, the actuator 6 is part of the adjustable orifice system.

A sensor 7 such as a position sensor senses movements of the adjustable orifice 6. The sensor 7 uses a static measurement principle as described above. That is, the sensor 7 has no moving parts. The sensor 7 also dispenses with an optical path that can be obstructed by particles and/or by moisture.

In some embodiments, the sensor 7 directly senses a position of the adjustable orifice of the control valve 5. That is, the sensor 7 is mounted at or near the adjustable orifice of the control valve 5. In some embodiments, the sensor 7 is integrated into the control valve 5 such that the control valve 5 comprises the sensor 7.

In some embodiments, the sensor 7 directly senses a position of the actuator 6. That is, the sensor 7 is mounted at or near the actuator 6. That is, the sensor 7 is mounted at or near a moveable member of the actuator 6. In some embodiments, the sensor 7 is integrated into the actuator 6 such that the actuator 6 comprises the sensor 7.

The position of the actuator 6 defines the position of the adjustable orifice of the control valve 6. It follows that the sensor 7 senses substantially the same position regardless of whether it is arranged at the actuator 6 or at the adjustable orifice. In some embodiments, the sensor 7 is part of the adjustable orifice system.

A controller 8 is in communicative connection with the actuator 6 and with the sensor 7. In some embodiments, the controller 8 comprises a microcontroller and/or a microprocessor. In some embodiments, the controller 8 is a microcontroller and/or is a microprocessor. In some embodiments, the controller 8 comprises a memory such as a non-volatile memory. That is, the controller 8 can comprise a microcontroller and a non-volatile memory. The controller 8 can also comprise a microprocessor and a non-volatile memory.

In some embodiments, the controller 8 comprises an application-specific integrated circuit (ASIC) such as an application-specific integrated circuit having a non-volatile memory. The controller 8 can still be an application-specific integrated circuit such as an application-specific integrated circuit having a non-volatile memory. Application-specific integrated circuits can be highly effective at obtaining and processing readings such as the readings from the sensor 7.

This ASIC provides more I/O interfaces not only for reading from the sensor 7 or from a microcontroller. The readings obtained by the ASIC are provided via an I/O output to a superordinate system. The ASIC also provides more I/O interfaces for reading and/or for processing a setting or command signal. The setting or command signal can originate from a superordinate system. It can be an analog or a digital signal.

In some embodiments, the controller 8 comprises a freely-programmable gate array such as a freely-programmable gate array having a non-volatile memory. The controller 8 can still be a freely-programmable gate array such as a freely-programmable gate array having a non-volatile memory. Freely-programmable gate arrays can be highly effective at obtaining and processing readings such as the readings from the sensor 7.

This FPGA provides more I/O interfaces not only for reading from the sensor 7 or from a microcontroller. The readings obtained by the FPGA are provided via an I/O output to a superordinate system. The FPGA also provides more I/O interfaces for reading and/or for processing a setting or command signal. The setting or command signal can originate from a superordinate system. It can be an analog or a digital signal.

In some embodiments, the controller 8 comprises a microcontroller connected to an ASIC. In some embodiments, the controller 8 comprises a microcontroller connected to a FPGA.

In some embodiments, the controller 8 comprises an inexpensive and/or low-power system-on-a-chip microcontroller having integrated wireless connectivity. In some embodiments, the system-on-a-chip microcontroller has a memory not exceeding one mebibyte.

The connection between the controller 8 and the actuator 6 can be bidirectional. A bidirectional connection affords flexibility. That is, the controller 8 can send position signals to the actuator 6. The controller 8 can also receive status signals from the actuator 6. The controller 8 can, by way of example, receive signals indicative of steps from an actuator 6 comprising a stepper motor.

The connection between the controller 8 and the actuator 6 can also be unidirectional. Communication from the controller 8 to the actuator 6 is facilitated by such a unidirectional connection. The actuator 6 can still receive position signals from the controller 8. A unidirectional connection reduces complexity.

In some embodiments, the controller 8 comprises a digital-to-analog converter. The digital-to-analog converter provides conversion of digital signals from the controller 8 into analog signals. The analog signal can be sent to the actuator 6. The analog signal can be amplified and afterwards be sent to the actuator 6. The digital-to-analog converter can be an integral part of the controller 8. In some embodiments, the digital-to-analog converter and the controller 8 are arranged on the same system-on-a-chip. More specifically, the digital-to-analog converter and the microcontroller of the controller 8 are arranged on the same system-on-a-chip.

The connection between the controller 8 and the sensor 7 can be bidirectional. A bidirectional connection affords flexibility. That is, the controller 8 can receive readings and/or recordings from the sensor 7. The controller 8 also functions to transmit settings to the sensor 7.

The connection between the controller 8 and the sensor 7 can still be unidirectional. Communication from the sensor 7 to the controller 8 is facilitated by such a unidirectional connection. The controller 8 can still receive readings and/or recordings from the sensor 7. A unidirectional connection reduces complexity.

In some embodiments, the controller 8 comprises an analog-to-digital converter. The analog-to-digital converter provides conversion of analog signals from the sensor 7 into (digital) measures. The analog-to-digital converter can be an integral part of the controller 8. In a compact embodiment, the analog-to-digital converter and the controller 8 are arranged on the same system-on-a-chip.

In some embodiments, the controller 8 comprises a sigma-delta converter. The sigma-delta converter provides conversion of analog signals from the sensor 7 into (digital) measures. The sigma-delta converter can be an integral part of the controller 8. That is, the sigma-delta converter and the controller 8 are arranged on the same system-on-a-chip.

In some embodiments, communication between the controller 8 and the actuator 6 involves a digital communication bus. Communication between the controller 8 and the actuator 6 involves a digital communication protocol. Likewise, communication between the controller 8 and the sensor 7 may involve a digital communication bus. Communication between the controller 8 and the sensor 7 may involve a digital communication protocol.

In some embodiments, the actuator 6 comprises a digital-to-analog converter. The digital-to-analog converter provides conversion of digital signals received from the controller 8 via the communication bus into analog signals. The analog signals can, by way of non-limiting example, be amplified following digital-to-analog conversion. The digital-to-analog converter can be an integral part of the actuator 6. In some embodiments, the actuator 6 comprises a digital-to-analog converter and a controller of the actuator 6. The controller of the actuator 6 can comprise a microcontroller and/or a microprocessor. The controller of the actuator 6 can even be a microcontroller and/or a microprocessor. In some embodiments, the controller of the actuator 6 and the digital-to-analog converter of the actuator 6 are arranged on the same system-on-a-chip.

In some embodiments, the sensor 7 can comprise an analog-to-digital converter. The analog-to-digital converter provides conversion of analog signals received from a sensor element of the sensor into digital signals. The digital signals can then be transmitted to the controller 8 via the communication bus. The analog signal received from the sensor element can, by way of non-limiting example, be amplified before analog-to-digital conversion. The analog-to-digital converter can be an integral part of the sensor 7. In some embodiments, the sensor 7 comprises an analog-to-digital converter and a controller of the sensor 7. The controller of the sensor 7 can comprise a microcontroller and/or a microprocessor. The controller of the sensor 7 can even be a microcontroller and/or a microprocessor. In a compact embodiment, the controller of the sensor 7 and the analog-to-digital converter of the sensor 7 are arranged on the same system-on-a-chip.

In some embodiments, the sensor 7 can also comprise a sigma-delta converter. The sigma-delta converter provides conversion of analog signals received from a sensor element of the sensor into digital signals. The digital signals can then be transmitted to the controller 8 via the communication bus. The analog signal received from the sensor element can, by way of non-limiting example, be amplified before sigma-delta conversion. The sigma-delta converter can be an integral part of the sensor 7. In some embodiments, the sensor 7 comprises a sigma-delta converter and a controller of the sensor 7. The controller of the sensor 7 can comprise a microcontroller and/or a microprocessor. The controller of the sensor 7 can even be a microcontroller and/or a microprocessor. In a compact embodiment, the controller of the sensor 7 and the sigma-delta converter of the sensor 7 are arranged on the same system-on-a-chip.

The controller 8 can be an item that is separate from the valve 5. In some embodiments, the valve 5 comprises the controller 8. The valve 5 and the controller 8 can even be arranged inside the same housing.

The controller 8 can be an item that is separate from the actuator 6. In some embodiments, the actuator 6 comprises the controller 8. The actuator 6 and the controller 8 can even be arranged inside the same housing.

The controller 8 can be an item that is separate from at least one item selected from the actuator 6 and the control valve 5. In some embodiments, the control valve 5 comprises the actuator 6 and the controller 8. The control valve 6, the actuator 6, and the controller 8 can even be arranged inside the same housing. It is still envisaged that the control valve 6, the adjustable orifice, the actuator 6, the controller 8 are arranged inside the same housing.

FIG. 1 shows a single consumer device in the form of an evaporator 3. The consumer device can deliver thermal energy to a space such as a room of a building. However, a cold exchange system 1 of the instant disclosure can comprise a plurality of consumer devices. The consumer devices then each provide cold to one or more spaces. The one or more spaces can comprise one or more rooms of a building. The one or more spaces can even be one or more rooms of a building.

Figure 2:
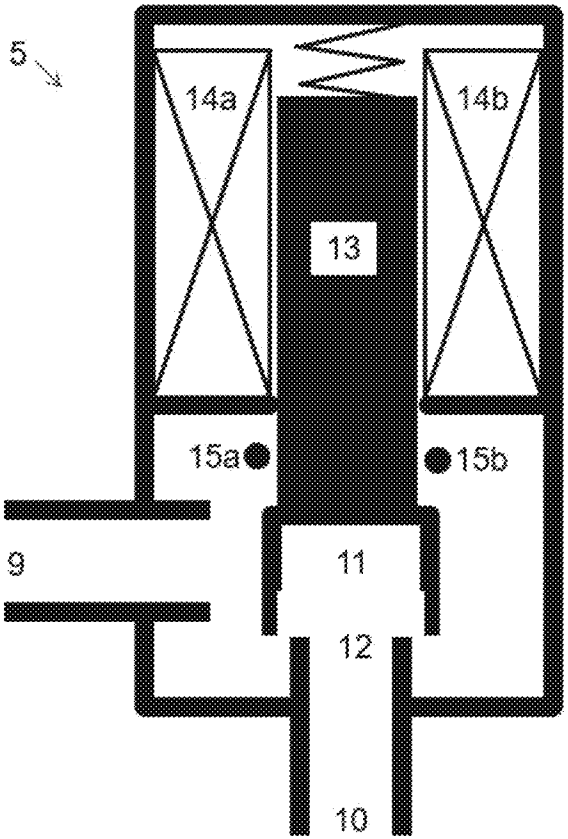
FIG. 2 shows an example expansion valve having a sensor incorporating teachings of the present disclosure.

A valve 5 such as an expansion valve and/or a controlled expansion valve is shown in FIG. 2. The valve 5 as shown in FIG. 2 comprises an inlet port 9 and an outlet port 10. The inlet port 9 is different from the outlet port 10.

A fluid path connects the inlet port 9 to the outlet port 10 and an adjustable orifice 11, 12 is situated in the fluid path. The adjustable orifice 11, 12 is moveable between an open position and a closed position. In the open position of the adjustable orifice 11, 12, a refrigerant can flow between the inlet port 9 and the outlet port 10. The refrigerant flowing from the inlet port 9 to the outlet port 10 is preferably selected from at least one of:

a R-401A refrigerant,
a R-404A refrigerant,
a R-406A refrigerant,
a R-407A refrigerant,
a R-407C refrigerant,
a R-408A refrigerant, a R-409A refrigerant,
a R-410A refrigerant,
a R-438A refrigerant,
a R-500 refrigerant,
a R-502 refrigerant, The refrigerant flowing from the inlet port 9 to the outlet port 10 can also be selected from at least two of:

a R-401A refrigerant,
a R-404A refrigerant,
a R-406A refrigerant,
a R-407A refrigerant,
a R-407C refrigerant,
a R-408A refrigerant,
a R-409A refrigerant,
a R-410A refrigerant,
a R-438A refrigerant,
a R-500 refrigerant,
a R-502 refrigerant,
ammonia.

The refrigerant flowing from the inlet port 9 to the outlet port 10 can still be selected from at least three of:

a R-401A refrigerant,
a R-404A refrigerant,
a R-406A refrigerant,
a R-407A refrigerant,
a R-407C refrigerant,
a R-408A refrigerant,
a R-409A refrigerant,
a R-410A refrigerant,
a R-438A refrigerant,
a R-500 refrigerant,
a R-502 refrigerant, In the closed position, the adjustable orifice 11, 12 obturates the fluid path between the inlet port 9 and the outlet port 10.

In some embodiments, the valve 5 does not fully close. A valve 5 not allowing a fully closed position can be in installations where a valve must not fully close. For example, it can be operated to not close valves in systems with flow control.

The adjustable orifice 11, 12 as shown in FIG. 2 comprises a cup-shaped, moveable member 11. The cup-shaped, moveable member 11 of the adjustable orifice 11, 12 mechanically connects to an armature 13. The armature 13 is part of the valve actuator 6. The valve actuator 6 comprises the armature 13 and a solenoid 14*a*, 14*b*. An electric current through the solenoid 14*a*, 14*b* causes movements of the armature 13 and of the cup-shaped member 11. The electric current through the solenoid 14*a*, 14*b* thereby affords closing and/or opening of the adjustable orifice 11, 12. In other words, the adjustable orifice system of the valve 5 of FIG. 2 comprises the adjustable orifice 11, 12, the armature 13 and the solenoid 14*a*, 14*b*.

In some embodiments, the armature 13 comprises a neodymium NdFeB magnet selected from at least one of a sintered $Nd_2Fe_{14}B$ magnet, or a bonded $Nd_2Fe_{14}B$ magnet.

In some embodiments, the armature 13 comprises a samarium-cobalt SmCo magnet selected from at least one of a sintered $SmCo_5$ magnet, or a sintered Sm (Co, Fe, Cu, Zr) 7 magnet.

In some embodiments, the armature 13 comprises a portion made of at least one of ferrite steel, and
DIN/EN 1.0715 steel in accordance with the standard EN 10277:2018.

Armatures comprising ferrite steel need not be ferromagnetic. The whole of the armature 13 may not be permanently magnetic. Where the whole of the armature 13 is not permanently magnetic, the armature 13 can be hollow. The hollow armature 13 can, by way of non-limiting example, comprise a hollow cylinder. The hollow armature 13 can, by way of another non-limiting example, comprise a tubular member.

In some embodiments, the hollow armature 13 comprises s an electrically conductive material such as steel, especially ferrite steel and/or austenite steel. In some embodiments, the hollow armature 13 is made of an electrically conductive material such as steel, especially ferrite steel and/or austenite steel. In some embodiments, the armature 13 comprises an electrically conductive material such as copper and/or aluminum and/or an alloy thereof. In some embodiments, the hollow armature 13 is made of an electrically conductive material such as copper and/or aluminum and/or an alloy thereof.

In some embodiments, the hollow armature 13 comprises a plurality of electrically conductive bars. The plurality of electrically conductive bars has a first end and has a second end. In some embodiments, the first end of the plurality of electrically conductive bars is different from the second end of the plurality of electrically conductive bars. A first electrically conductive portion can be arranged at the first end of the plurality of electrically conductive bars. The first electrically conductive portion electrically interconnects several or all the electrically conductive bars of the plurality of conductive bars. The first electrically conductive portion thus affords electric conductivity between several or between all the electrically conductive bars of the plurality of conductive bars. The first electrically conductive portion can comprise an electrically conductive material such as steel and/or copper and/or aluminum and/or an alloy thereof. The first electrically conductive portion can also be made of an electrically conductive material such as steel and/or copper and/or aluminum and/or an alloy thereof.

A second electrically conductive portion can be arranged at the second end of the plurality of electrically conductive bars. The second electrically conductive portion electrically interconnects several or all the electrically conductive bars of the plurality of conductive bars of the hollow armature 13. The second electrically conductive portion thus affords electric conductivity between several or between all the electrically conductive bars of the plurality of conductive bars. The second electrically conductive portion can comprise an electrically conductive material such as steel and/or copper and/or aluminum and/or an alloy thereof. The second electrically conductive portion can also be made of an electrically conductive material such as steel and/or copper and/or aluminum and/or an alloy thereof. The second electrically conductive portion of the hollow armature 13 is preferably different from the first electrically conductive portion of the hollow armature 13.

One or more windings 15*a*, 15*b* of the sensor 7 are illustrated in FIG. 2. An electric current will flow through the one or more windings 15*a*, 15*b* in response to a movement of the armature 13. To that end, the one or more windings 15*a*, 15*b* are disposed in close proximity to the armature 13. It is envisaged that the sensor 7 such as the position sensor 7 comprises an annular portion.

In view of accurate readings, the closest distance between the one or more windings 15*a*, 15*b* and the armature 13 may be less than twenty millimeters. The closest distance between the one or more windings 15*a*, 15*b* and the armature 13 can even be less than ten millimeters. In some embodiments, the closest distance between the one or more windings 15*a*, 15*b* and the armature 13 can be less than five millimeters.

The sensor 7 having the one or more windings 15*a*, 15*b* illustrated in FIG. 2 is a sensor having a static measurement principle. Due to the static measurement principle, moving parts like for example a wiper of a potentiometer are avoided. The static measurement principle may be used, as it has been found that moving parts may lead to inaccurate measurements and require frequent maintenance. What's more, the sensor 7 illustrated in FIG. 2 is not prone to malfunctions caused by particles obstructing an optical path.

The valve 5 as shown in FIG. 1 and in FIG. 2 is a two-way valve. The instant disclosure also applies to three-way valves. The actuator comprising the armature 13 and the solenoid 14 as shown in FIG. 2 is a linear actuator. The present disclosure is not limited to linear actuators. Instead, the present disclosure also applies to non-linear actuators such as stepper motors.

The characteristic values or characteristic curve of an adjustable orifice system gives the correct relationship between the medium flow and the position of the adjustable orifice. More specifically, it gives the correct relationship between a flow rate of the refrigerant and the position of the adjustable orifice. The relationship is based on an assumption of constant pressure. The concept of characteristic curves likewise applies to control valves having adjustable orifice systems.

Figure 3:
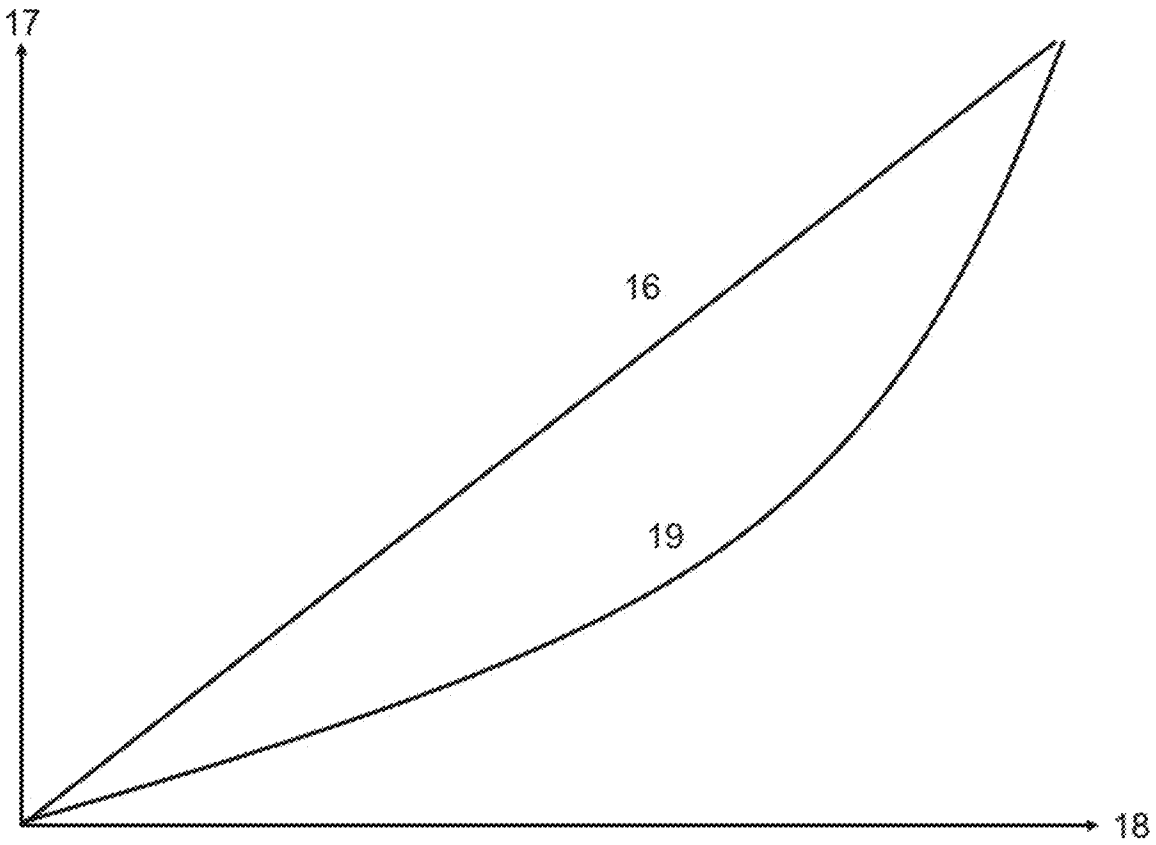
FIG. 3 illustrates various characteristic curves.

The orifice adjusting system 11, 12, 13, 14*a*, 14*b* can be constructed such that it has a linear characteristic curve. A linear characteristic curve 16 of a flow rate 17 of the refrigerant 17 versus position 18 of the adjustable orifice is illustrated in FIG. 3. In accordance with this characteristic curve, a flow Φ is a linear function of the position x of the adjustable orifice:

$$\Phi \propto x$$

This linear characteristic curve can be achieved by shaping the movable part 11, 12, by means of which the orifice is adjusted. This linear characteristic curve can also be achieved by means of the actuator 6, 13, 14*a*, 14*b*, wherein the actuator moves the adjustable orifice 11, 12. The linear characteristic curve can still be achieved or be changed by processing the signal sent by the controller 8 to the actuator 6, 13, 14*a*, 14*b*. More specifically, the signal sent by the controller 8 to the actuator 6, 13, 14*a*, 14*b* is modified. The linear characteristic curve is thus achieved or is changed software-wise.

The orifice adjusting system 11, 12, 13, 14*a*, 14*b* can also be constructed such that it has an equal-percentage characteristic curve. An equal-percentage characteristic curve 19 of a flow rate 17 of the refrigerant versus position 18 of the adjustable orifice is illustrated in FIG. 3. In accordance with this characteristic curve, a flow Φ is an exponential function of the position x of the adjustable orifice:

$$\Phi \propto e^x$$

That exponential function $e^x$ is never zero regardless of the position x. Since adjustable orifices in many circumstances need to close, the equal-percentage characteristic curve is often supplemented by a linear curve at small flow rates. The equal-percentage curve then at small flow rates comprises a linear portion and the linear portion crosses zero as the adjustable orifice 11, 12 closes.

This equal-percentage characteristic curve can either be achieved by shaping the movable parts, by means of which the orifice is adjusted. This equal-percentage characteristic curve can also be achieved by means of the actuator, wherein the actuator moves the adjustable orifice. The equal-percentage characteristic curve can be achieved or be changed by processing the signal sent by the controller 8 to the actuator 6. More specifically, the signal sent by the controller 8 to the actuator 6 is modified. The equal-percentage characteristic curve is thus achieved or is changed software-wise.

Some embodiments of the teachings of the instant disclosure include a cold exchange system (1) comprising: a control system and one or more thermal energy exchangers (3) connected to a pipe system via which a refrigerant is distributed, the control system being associated with at least one of the one or more thermal energy exchangers (3), the control system comprising: an orifice adjusting system (5, 6) being formed by a two-way or three-way valve (5) and by an actuator (6), the valve (5) comprising a flow chamber with an adjustable orifice (11, 12) in the pipe part; the control system comprising a position sensor (7) configured to sense a position of the adjustable orifice (11, 12) and/or of the actuator (6) and to output a signal indicative of the sensed position, the position sensor (7) having a static measurement principle; the control system comprising a controller (8) in communicative connection with the orifice adjusting system (5, 6) and with the position sensor (7); wherein the controller (8) is configured to evaluate the signal indicative of the sensed position with a set position of the adjustable orifice (11, 12) and to output a control signal based on the evaluation; and the orifice adjusting system (5, 6) being configured to adjust the adjustable orifice (11, 12) in response to the control signal; wherein a software-wise change of a characteristic curve of the orifice adjusting system (5,6) is implemented in the control system.

In an embodiment, the control system is configured to control a flow of the refrigerant passing through a pipe part of the pipe system.

In some embodiments, the at least one of the thermal energy exchangers (3) is in fluid communication with the adjustable orifice (11, 12).

In some embodiments, the signal indicative of the sensed position comprises an electric signal indicative of the sensed position. The signal indicative of the sensed position may be an electric signal indicative of the sensed position. More specifically, the signal indicative of the sensed position can comprise an electric signal indicative of an actual sensed position of the adjustable orifice (11, 12) and/or of the actuator (6). The signal indicative of the sensed position can even be an electric signal indicative of an actual sensed position of the adjustable orifice (11, 12) and/or of the actuator (6).

In some embodiments, the characteristic curve changes by means of the actuator (6) adjusting the position of the adjustable orifice (11, 12).

In some embodiments, changing the characteristic curve involves at least one of:

- modifying the control signal,
- the controller (8) modifying the control signal,
- modifying the set position of the adjustable orifice (11, 12),
- the controller (8) modifying the set position of the adjustable orifice (11, 12).

In some embodiments, the control system is configured to control the orifice adjusting system (5, 6) based on the changed characteristic curve.

The actuator (6) mechanically connects to the adjustable orifice (11, 12).

In some embodiments, the actuator (6) is configured to adjust the adjustable orifice (11, 12) in response to the control signal.

In some embodiments, the position sensor (7) comprises at least one inductor.

In some embodiments, the at least one inductor of the position sensor (7) comprises one or more windings. In some embodiments, the at least one inductor comprises at least one coil. In some embodiments, the at least one inductor is at least one coil. More specifically, the at least one inductor can comprise at least one coil of a linear variable inductive transducer. The at least one inductor can be at least one coil of a linear variable inductive transducer.

In some embodiments, the at least one inductor of the position sensor (7) envelopes a moveable portion of at least one of the adjustable orifice (11, 12), the actuator (6).

In some embodiments, the position sensor (7) comprises an amplifier electrically connected to the at least one inductor, the amplifier being configured to amplify a current signal received from the at least one inductor and to output the signal indicative of the sensed position in analog form.

In some embodiments, the position sensor (7) comprises an amplifier electrically connected to the at least one inductor and an analog-to-digital converter electrically connected to the amplifier, the amplifier being configured to amplify a current signal received from the at least one inductor and to output the amplified signal to the analog-to-digital converter; and the analog-to-digital converter being configured to output the signal indicative of the sensed position in digital form in response to receiving the amplified signal.

In some embodiments, the position sensor (7) comprises an amplifier electrically connected to the at least one inductor and a sigma-delta converter electrically connected to the amplifier, the amplifier being configured to amplify a current signal received from the at least one inductor and to output the amplified signal to the sigma-delta converter; and the sigma-delta converter being configured to output the signal indicative of the sensed position in digital form in response to receiving the amplified signal.

In some embodiments, the amplifier comprises an operational amplifier. Sensors (7) having digital output signals minimise losses of accuracy when the signal is transmitted to the controller (8).

In some embodiments, the characteristic curve is changed from a linear characteristic curve (16) to a characteristic curve different from the linear characteristic curve (16), or vice versa.

In some embodiments, the characteristic curve is changed from an equal-percentage characteristic curve (19) to a characteristic curve different from the equal-percentage characteristic curve (16), or vice versa.

The combination of an equal-percentage characteristic curve of the orifice adjusting system (5, 6) and a characteristic of the thermal energy exchanger (3) improves control. The combination of the equal-percentage characteristic curve of the orifice adjusting system (5, 6) and the characteristic of the thermal energy exchanger (3) can result in a linear system. The system can thus be controlled as a linear system as opposed to a non-linear system. Linear systems are typically easier to control than non-linear systems.

In some embodiments, the controller (8) comprises a non-volatile memory storing a firmware; and the software-wise change of the characteristic curve of the orifice adjusting system (5, 6) is implemented using the firmware of the controller (8). The firmware solution enables manufacture, commissioning, and installation of the cold exchange system (1) at industrial scale. That is, the controllers (8) of the cold exchange systems (1) no longer need be individually programmed in the field. Instead, the firmware and the change of the characteristic curve are programmed during manufacture.

In some embodiments, the control system comprises a first temperature sensor provided along the pipe system in a position in front of the at least one thermal energy exchanger (3); and the first temperature sensor is configured to sense a supply temperature of the refrigerant entering the at least one thermal energy exchanger (3).

In some embodiments, the control system comprises a second temperature sensor provided along the pipe system in a position behind the at least one thermal energy exchanger (3); and the second temperature sensor is configured to sense a return temperature of the refrigerant leaving the at least one thermal energy exchanger (3).

In some embodiments, the control system comprises a communication link toward a central controller.

In some embodiments, the controller (8) of the control system is configured to communicate at least one of the signal indicative of the sensed position, a value derived from the signal indicative of the sensed position to the central controller via the communication link. The central unit can then monitor actual positions and determine wear of any moveable portions of the adjustable orifice system (5, 6).

In some embodiments, the controller (8) is in communicative connection with the first and second temperature sensors; wherein the first and second temperature sensors are configured to output temperature signals and to send them to the controller (8); wherein the controller (8) is configured to receive the temperature signals from the temperature sensors and to determine a differential temperature as a function of the temperature signals; and wherein the controller (8) is configured to communicate the differential temperature to the central controller via the communication link. The central unit can then monitor temperature differences across the at least one thermal energy exchanger (3).

In some embodiments, the controller (8) is configured to receive the temperature signals from the temperature sensors and to produce a first measure of temperature from the temperature signal received from the first temperature sensor and to produce a second measure of temperature from the temperature signal received from the second temperature sensor and to determine a differential temperature as a function of the first and second measures.

In some embodiments, the refrigerant is chosen and/or selected from at least one of a R-401A refrigerant, a R-404A refrigerant, a R-406A refrigerant, a R-407A refrigerant, a R-407C refrigerant, a R-408A refrigerant, a R-409A refrigerant, a R-410A refrigerant, a R-438A refrigerant, a R-500 refrigerant, a R-502 refrigerant, ammonia, a mixture thereof.

It is stressed that the foregoing relates only to certain embodiments of the disclosure. Numerous changes can be made therein without departing from the scope of the disclosure as defined by the following claims. It should also be understood that the disclosure is not restricted to the illustrated embodiments.

Various modifications can be made within the scope of the following claims.

REFERENCE NUMERALS

1 cold exchange system
2 compressor
3 thermal energy exchanger
4 condenser
5 valve
6 actuator
7 sensor
8 controller
9 first port
10 second port
11, 12 adjustable orifice
13 armature
14*a*, 14*b* solenoid
15*a*, 15*b* inductor
16 linear characteristic curve
17 flow rate
18 valve position
19 equal-percentage characteristic curve

The invention claimed is:

1. A cold exchange system comprising:

one or more thermal energy exchangers connected to a pipe system distributing a refrigerant;

a control system associated with at least one of the one or more thermal energy exchangers, the control system comprising:

an orifice adjusting system including a valve and an actuator, the valve comprising a flow chamber with an adjustable orifice in a first pipe of the pipe system;

a position sensor to sense a position of the adjustable orifice and/or the actuator and generate a signal indicative of the sensed position;

a controller in communication with the orifice adjusting system and the position sensor;

wherein the orifice adjusting system adjusts the adjustable orifice in response to a control signal;

wherein the control system uses a software-wise change of a characteristic curve of the orifice adjusting system;

wherein the position sensor operates using a static measurement principle; and the controller compares the signal to a set position of the adjustable orifice and generates the control signal based on the comparison.

2. The cold exchange system according to claim 1, wherein the position sensor comprises an inductor.

3. The cold exchange system according to claim 2, wherein the inductor envelopes a moveable portion of at least one of the adjustable orifice and the actuator.

4. The cold exchange system according to claim 2, wherein:

the position sensor comprises an amplifier electrically connected to the inductor; and the amplifier is configured to amplify a current signal received from the inductor and generate the signal.

5. The cold exchange system according to claim 2, wherein:

the position sensor comprises an amplifier electrically connected to the inductor and an analog-to-digital converter electrically connected to the amplifier;

the amplifier amplifies a current signal received from the inductor and provide the amplified signal to the analog-to-digital converter; and the analog-to-digital converter generates the signal in digital form.

6. The cold exchange system according to claim 2, wherein:

the position sensor comprises an amplifier electrically connected to the inductor and a sigma-delta converter electrically connected to the amplifier;

the amplifier amplifying a current signal received from the inductor and transmit the amplified signal to the sigma-delta converter; and the sigma-delta converter generating the signal in digital form in response to receiving the amplified signal.

7. The cold exchange system according to claim 1, wherein:

the software-wise change of the characteristic curve includes a change from a linear characteristic curve to a characteristic curve different from the linear characteristic curve, or vice versa;

the controller comprises a non-volatile memory storing a firmware; and the software-wise change of the characteristic curve of the orifice adjusting system uses the firmware of the controller.

8. The cold exchange system according to claim 1, wherein:

the software-wise change of the characteristic curve includes a change from an equal-percentage characteristic curve to a characteristic curve different from the equal-percentage characteristic curve, or vice versa;

the controller comprises a non-volatile memory storing a firmware; and the software-wise change of the characteristic curve of the orifice adjusting system is implemented using the firmware of the controller.

9. The cold exchange system according to claim 1, wherein:

the control system comprises a first temperature sensor provided along the pipe system in a position in front of the at least one thermal energy exchanger; and the first temperature sensor senses a supply temperature of the refrigerant entering the at least one thermal energy exchanger.

10. The cold exchange system according to claim 1, wherein:

the control system comprises a second temperature sensor provided along the pipe system in a position behind the at least one thermal energy exchanger; and the second temperature sensor senses a return temperature of the refrigerant leaving the at least one thermal energy exchanger.

11. The cold exchange system according to claim 1, wherein the control system comprises a communication link to a central controller.

12. The cold exchange system according to claim 11, wherein the controller communicates at least one of: the signal indicative of the sensed position, or a value derived from the signal indicative of the sensed position, to the central controller via the communication link.

13. The cold exchange system according to claim 9, wherein:

the controller is in communicative connection with the first temperature sensor and a second temperature sensor;

the first and second temperature sensors output respective temperature signals and to send them to the controller;

the controller receives the temperature signals from the temperature sensors and determines a differential temperature as a function of the temperature signals; and the controller communicates the differential temperature to the central controller.

14. The cold exchange system according to claim 1, wherein the refrigerant comprises at least one fluid chosen from the group consisting of: a R-401A refrigerant, a R-404A refrigerant, a R-406A refrigerant, a R-407A refrigerant, a R-407C refrigerant, a R-408A refrigerant, a R-409A refrigerant, a R-410A refrigerant, a R-438A refrigerant, a R-500 refrigerant, a R-502 refrigerant, and ammonia.

* * * * *